US010988363B1

(12) United States Patent
Chisholm

(10) Patent No.: US 10,988,363 B1
(45) Date of Patent: Apr. 27, 2021

(54) SYSTEM FOR PREVENTING DRIPPING FROM NOZZLES IN A CONTAINER FILLING SYSTEM

(71) Applicant: Owens-Brockway Glass Container Inc., Perrysburg, OH (US)

(72) Inventor: Brian J Chisholm, Sylvania, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

(21) Appl. No.: 16/269,332

(22) Filed: Feb. 6, 2019

(51) Int. Cl.
*B67C 3/26* (2006.01)

(52) U.S. Cl.
CPC ..... *B67C 3/2614* (2013.01)

(58) Field of Classification Search
CPC ..... B67C 3/2608; B67C 3/26; B67C 3/2614; B67C 3/2611
USPC ..... 141/90, 91, 115, 116, 117
See application file for complete search history.

(56) References Cited

U.S. PATENT DOCUMENTS 3,097,671 A 7/1963 Bonetti et al.
3,693,672 A * 9/1972 Hiland ..... B65B 1/16 141/7
4,976,296 A 12/1990 Pope
4,987,934 A * 1/1991 Groom ..... B67C 3/004 141/65
5,437,316 A 8/1995 McPherson
5,756,155 A 5/1998 Tzeng et al.
5,988,526 A 11/1999 Tzeng et al.
6,056,208 A 5/2000 Pirker et al.
6,484,762 B2 11/2002 Fehland et al.
8,490,659 B2 7/2013 Laguzzi
2013/0068344 A1 * 3/2013 Graffin ..... B67C 3/262 141/7

FOREIGN PATENT DOCUMENTS

EP 0351872 A1 1/1990

* cited by examiner

*Primary Examiner* — Mary E McManmon
*Assistant Examiner* — Christopher M Afful
(74) *Attorney, Agent, or Firm* — Reising Ethington P.C.

(57) ABSTRACT

A system for preventing dripping from filler nozzles providing matter to containers includes a manifold defining a bore extending therethrough and a channel in communication with the bore. The system further includes a nozzle ring supported within the bore of the manifold and defining a bore configured to receive a filler nozzle. The nozzle ring defines an air gap between an inner surface of the nozzle ring and an outer surface of the filler nozzle and a channel extending between the inner surface of the nozzle ring and an outer surface of the nozzle ring and in communication with the channel in the manifold. Negative pressure introduced into the channel in the manifold draws matter from the filler nozzle through the channels in the nozzle ring and manifold.

20 Claims, 3 Drawing Sheets

SYSTEM FOR PREVENTING DRIPPING FROM NOZZLES IN A CONTAINER FILLING SYSTEM

BACKGROUND a. Field

This disclosure relates to filling systems used to fill containers with liquids or other matter. In particular, the disclosure relates to a system that prevents matter from dripping from filler nozzles onto the exterior of the containers as the containers are moved into, and away from, a filling position.

b. Background Art

In conventional filling systems, filler nozzles expel liquids and other forms of matter into the mouths of containers positioned under the filler nozzles. When the containers are fill, the containers are moved or indexed to a subsequent station. As the containers are being moved, however, drips from the filler nozzles may fall onto the lips and/or sides of the containers. These drips contaminate the lips of the containers and make subsequent heat-sealing of closures such as foil seals onto the containers more difficult. As a result, seals must be installed with a relatively high strength that makes opening the containers more difficult for consumers. In conventional filling systems, a drip tray is moved into and out of a space between the fillers nozzles and the containers while the containers are moved. In some filler systems, however, there is insufficient space to permit a drip tray in this location.

The inventor herein has recognized a need for a system for preventing dripping from one or more filler nozzles that provide matter to containers that will minimize and/or eliminate one or more of the above-identified deficiencies.

BRIEF SUMMARY

This disclosure relates to filling systems used to fill containers with liquids or other matter. In particular, the disclosure relates to a system that prevents matter from dripping from filler nozzles onto the exterior of the containers as the containers are moved into, and away from, a filling position.

A system for preventing dripping from one or more filler nozzles that provide matter to containers in accordance with one embodiment includes a manifold defining a bore extending therethrough and defining a channel in communication with the bore. The system further includes a nozzle ring supported within the bore of the manifold and defining a bore configured to receive a filler nozzle. The nozzle ring defines an air gap between an inner surface of the nozzle ring and an outer surface of the filler nozzle. The nozzle ring further defines a channel extending between the inner surface of the nozzle ring and an outer surface of the nozzle ring and in communication with the channel in the manifold. A negative pressure introduced into the channel in the manifold draws matter from the filler nozzle through the channel in the nozzle ring and the channel in the manifold.

A filling system for filling one or more containers with matter in accordance with one embodiment includes a filler nozzle configured to provide matter to a container. The system further includes a manifold defining a bore extending therethrough and defining a channel in communication with the bore. The system further includes a nozzle ring supported within the bore of the manifold and defining a bore configured to receive the filler nozzle. The nozzle ring defines an air gap between an inner surface of the nozzle ring and an outer surface of the filler nozzle. The nozzle ring further defines a channel extending between the inner surface of the nozzle ring and an outer surface of the nozzle ring and in communication with the channel in the manifold. The system further includes a vacuum pump configured to generate a negative pressure in the channel in the manifold to draw matter from the filler nozzle through the channel in the nozzle ring and the channel in the manifold.

A system in accordance the present teachings represents an improvement as compared to conventional systems for preventing dripping from filler nozzles. The system has a relatively low profile and is capable of use in locations where space constraints prevent movement of a drip tray into and out of position between the filler nozzles and containers. The system can also be easily adapted to existing filling systems. Finally, the system can be easily removed from the filling system for cleaning and other maintenance.

The foregoing and other aspects, features, details, utilities, and advantages of the present disclosure will be apparent from reading the following description and claims, and from reviewing the accompanying drawings.

DETAILED DESCRIPTION

Figure 1:
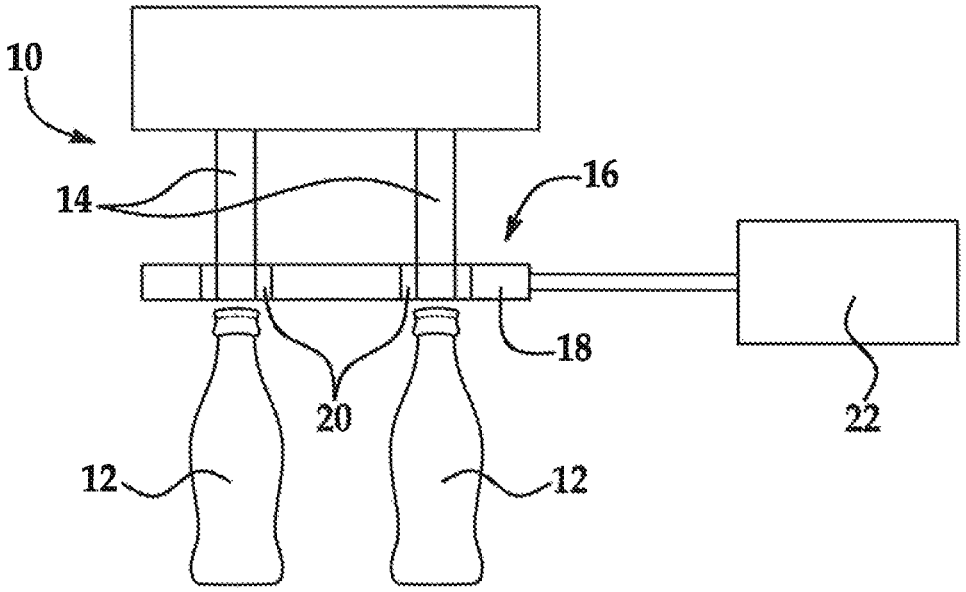
FIG. 1 is a diagrammatic view of one embodiment of a filler system.

Referring now to the drawings wherein like reference numerals are used to identify identical components in the various views, FIG. 1 illustrates a filling system 10 for filling containers 12 with matter. The matter may comprise solid or liquid foodstuffs, but it should be understood that system 10 may be used to fill containers 12 with a wide variety of matter. The containers 12 may comprise bottles or other containers and may be made from a variety of materials including glass, metals (e.g., aluminum) or plastics. System 10 may include one or more filler nozzles 14 and a system 16 for preventing matter from dripping from nozzles 14 between filling operations as containers 12 are transported to and from the location of filling system 10.

Filler nozzles 14 provide matter to fill containers 12. Nozzles 14 may be supported on a frame and may have an inlet coupled to an outlet of a hopper, hose or another mechanism for delivery of matter to nozzles 14. It will be understood that the particular structure of the filling system 10 will depend on the application and the type of matter being inserted into containers 12. Each filler nozzle 14 includes one more outlets at one end through which matter exits the nozzle 14 for entry into a corresponding container 12. In the illustrated embodiment, system 10 includes two filler nozzles 14. It should be understood, however, that the number of filler nozzles in system 10 will depend on the application.

System 16 prevents dripping from nozzles 14 between filling operations and as containers 12 are transported to and from filling system 10. Certain types of matter (e.g., liquids) may adhere to the exterior surface of filler nozzles 14 after delivery of matter from filler nozzles 14 has ceased due to adhesion/surface tension of the matter or incomplete nozzle shut off. Filling systems often lack any feature to suction back matter to keep the nozzles clean; this matter may then unintentionally drip onto the surfaces of containers 12 or other surfaces. Matter that drips onto the lip of a container 12 can contaminate the surfaces that are used in sealing the container 12. As a result, certain seals may not properly seal the container against matter leaking from the container 12 or against contamination of matter within the container 12. Stronger seals may be used to reduce these risks, but increase the difficulty in opening containers 12 and may lead to customer dissatisfaction. System 16 prevents matter from dripping from nozzles 14 onto containers 12 between filling operations. In accordance with one embodiment, system 16 may include a manifold 18, one or more nozzle rings 20 and a vacuum pump 22.

Figure 2:
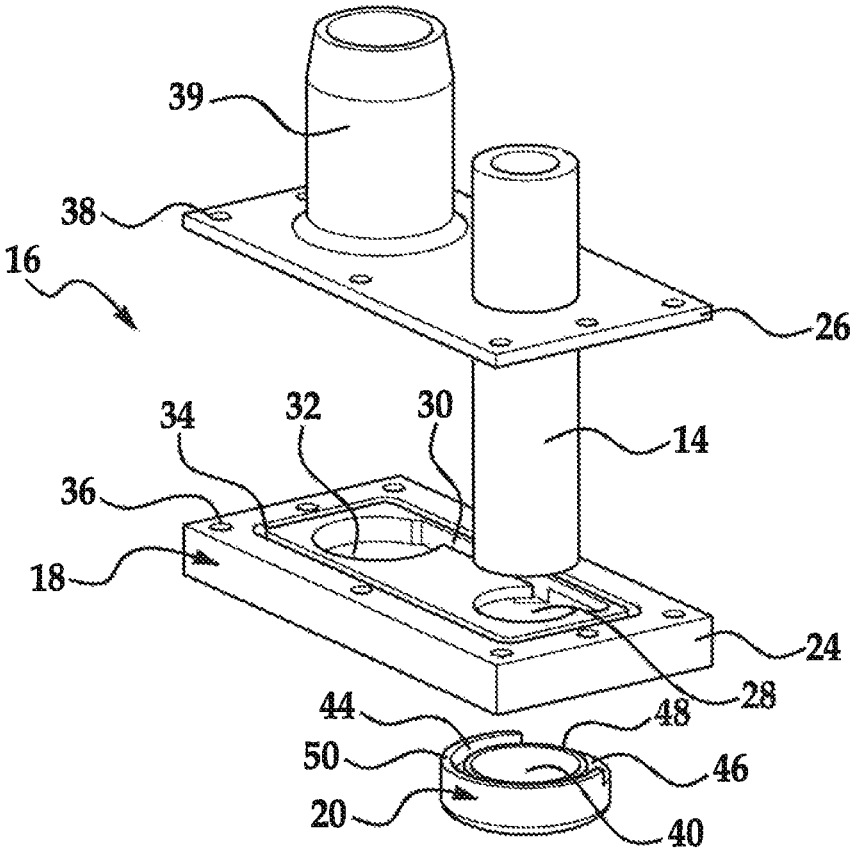
FIG. 2 is an exploded view of one embodiment of a system for preventing dripping from one or more filler nozzles that provide matter to containers.
Figure 3:
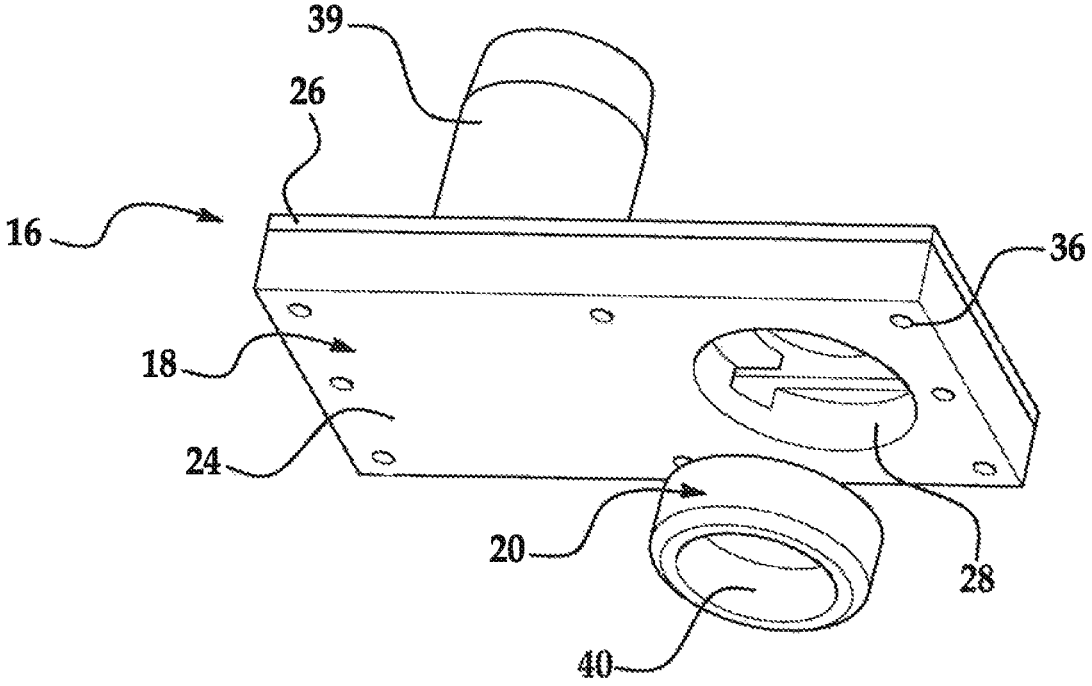
FIG. 3 is a partially exploded view of the system of FIG. 2.
Figure 4:
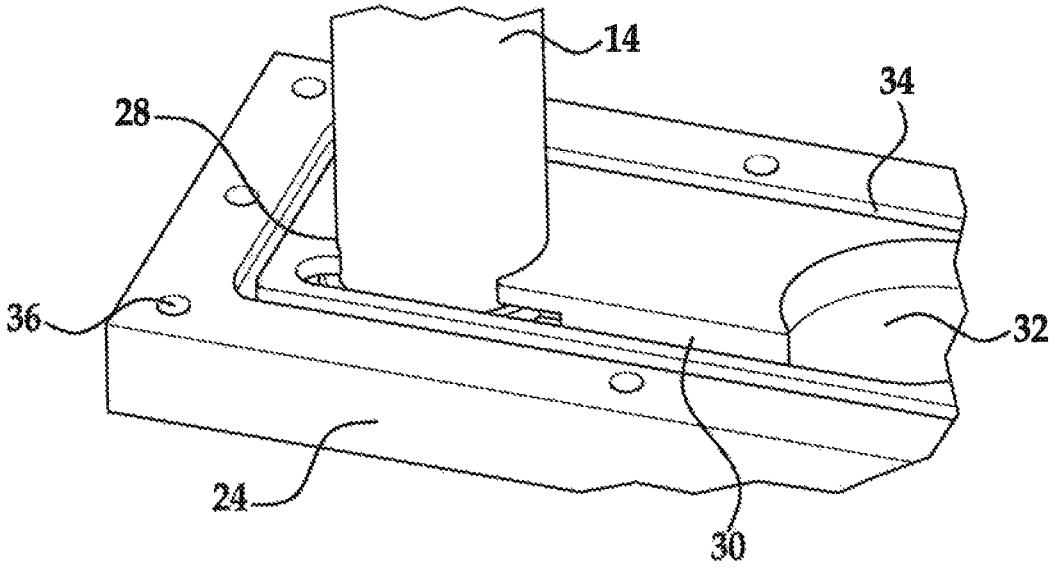
FIG. 4 is a perspective view of a portion of the system of FIG. 2.

Manifold 18 supports nozzle rings 20 and defines one or more channels through which matter may be moved away from nozzles 14. Manifold 18 may be made from conventional metals and/or plastics. Referring to FIGS. 2-3, one embodiment of a manifold 18 is illustrated. In the illustrated embodiment, manifold 18 is configured to support a single nozzle ring 20 and receive a single filler nozzle 14. It should be understood, however, that manifold 18 may be configured to support a plurality of nozzle rings 20 and receive a corresponding plurality of filler nozzles 14 as shown in FIG. 1. In the illustrated embodiment, manifold 18 is generally rectangular in shape. It should be understood, however, that the shape of manifold 18 may vary. Manifold 18 may include multiple members 24, 26.

Figure 5:
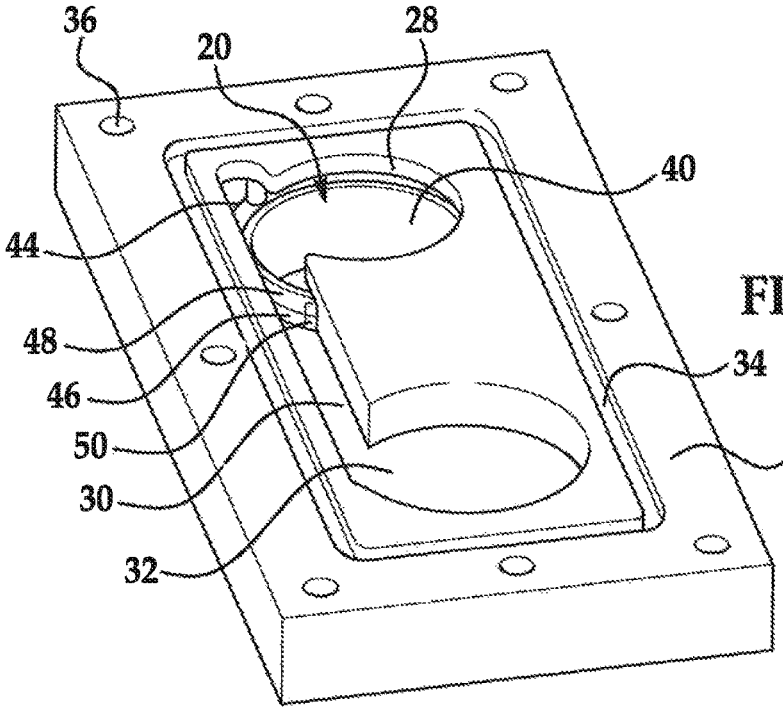
FIG. 5 is a perspective view of a portion of the system of FIG. 2.

Member 24 defines a bore 28 extending therethrough that is configured to receive a nozzle ring 20 and a nozzle 14. The size of bore 28 varies along its length such that bore 28 is larger in size proximate one end of bore 28 (the portion of the bore 28 configured to receive nozzle ring 20 in addition to filler nozzle 14 (best shown in FIGS. 3 and 7)) than an opposite end of bore 28 (the portion of bore 28 configured to receive only filler nozzle 14 (best shown in FIGS. 2 and 4-6)). Member 24 further defines one or more channels therein including a channel 30 in communication with bore 28. Channel 30 is configured to allow passage of fluids and other matter. Referring to FIG. 5, in accordance with some embodiments member 24 may further define a matter collection chamber 32 configured to collect matter removed from the end of nozzles 14. It should be understood, however, that manifold 18 may alternatively simply route matter to an external collection chamber. In the illustrated embodiment, chamber 32 is generally circular in shape, but it should be understood that the shape of chamber 32 may vary. Chamber 32 may be located at an opposite end of channel 30 relative to bore 28 and may, therefore, be in fluid communication with channel 30. Member 24 may further define a groove 34 surrounding bore 28, channel 30 and chamber 32 and configured to receive a seal (not shown). Member 24 may also define a plurality of fastener bores 36 configured to receive fasteners (not shown) such as bolts, screws or pins used to couple members 24, 26 together.

Referring again to FIG. 2, member 26 may act as a cover that encloses bore 28, channel 30 and chamber 32 in member 24. Member 26 defines a bore extending therethrough that is aligned with bore 28 in member 24 and configured to receive nozzle 14. Member 26 further defines a plurality of fastener bores 38 configured for alignment with fastener bores 36 in member 24 and configured to receive fasteners (not shown) such as bolts, screws or pins used to couple members 24, 26 together. Member 26 may further define a port 39 configured for connection to vacuum pump 22 such that pump 22 is in fluid communication with chamber 32, channel 30 and bore 28.

Figure 6:
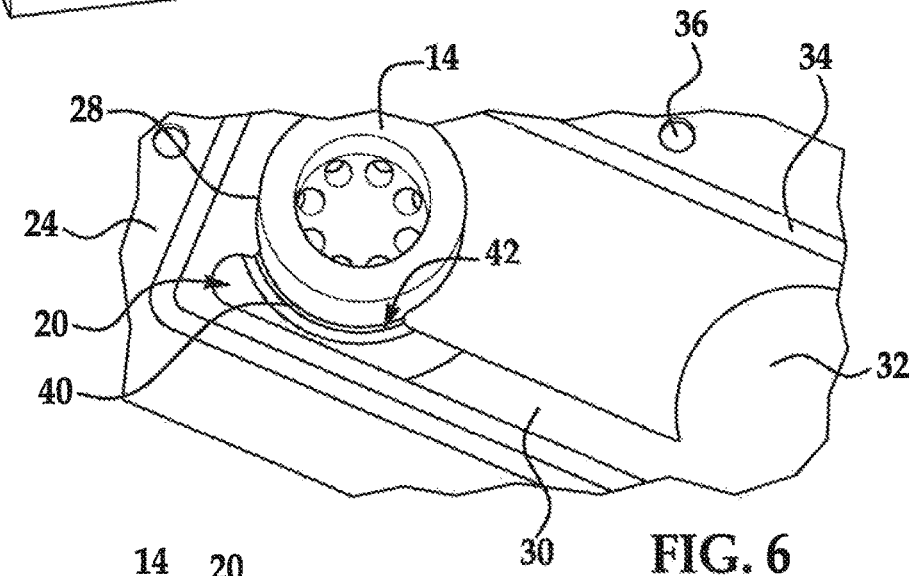
FIG. 6 is a top view of a portion of the system of FIG. 2.
Figure 7:
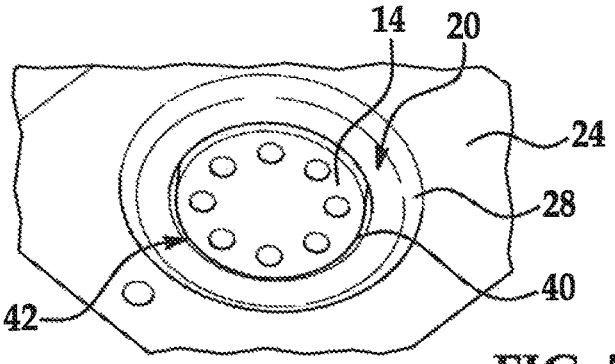
FIG. 7 is a bottom view of a portion of the system of FIG. 2.

Nozzle ring 20 defines a pathway to route matter from nozzle 14 to channel 30 in manifold 18. Nozzle ring 20 may be made from conventional metals or plastics. Nozzle ring 20 may be supported within bore 28 of manifold 18 through a friction/interference fit with an o-ring seal that surrounds nozzle ring 20 (during operation, negative pressure from pump 22 will further assist in retaining nozzle ring 20 within bore 28 of manifold 18). Therefore, manifold 18 and nozzle ring 20 can be moved relative to filler system 10 as a unit when necessary for cleaning or other maintenance. Nozzle ring 20 is annular in shape and defines a bore 40 that is concentric with bore 28 in manifold 18 and is configured to receive filler nozzle 14. Referring to FIGS. 6-7, bore 40 is sized to define an air gap 42 between an inner surface of nozzle ring 20 and an outer surface of filler nozzle 14. Matter on the exterior of nozzle 14 is drawn directly from the exterior surface of filler nozzle 14 across air gap 42 during operation of system 16. As discussed above, the size of bore 28 in manifold 18 varies along its length and a portion of the bore 28 in manifold 18 is smaller in size than bore 40 in nozzle ring 20 such that bore 28 in manifold 18 maintains the position of filler nozzle 14 and the air gap 42 between filler nozzle 14 and nozzle ring 20. Referring to FIGS. 2 and 5, nozzle ring 20 further defines a channel 44 that is in fluid communication with bore 40 in nozzle ring 20 and channel 30 in manifold 18 upon assembly. Channel 44 is formed in one end of nozzle ring 20 and extends between the inner surface of nozzle ring 20 and an outer surface of nozzle ring 20. Channel 44 is defined by a bottom wall 46 and inner and outer walls 48, 50. Inner wall 48 defines the inner surface of nozzle ring 20 and outer wall 50 defines the outer surface of nozzle ring 20. The length of inner wall 48 is less than the length of outer wall 50 and defines the inlet for channel 44 through which matter from nozzle 14 is drawn. The inlet extends about the entire circumference of the inner surface of nozzle ring 20. The length of inner wall 48 is constant while the length of outer wall 50 varies to define an outlet of fluid channel 44 and establish fluid communication between channel 44 and channel 30 in in manifold 18. Bottom wall 46 of channel 44 is level with the bottom wall in channel 30 in manifold 18. Matter drawn from filler nozzle 14 travels across the air gap 42 through the inlet defined by inner wall 48 and into channel 44 in nozzle ring 20. Matter flows outward from channel 44 through the outlet in outer wall 50 and into channel 30 of manifold 18.

Vacuum pump 22 generates a negative pressure within collection chamber 32 and channel 30 in manifold 18 and channel 44 in nozzle ring 20, respectively, and across air gap 42. The negative pressure, or vacuum, draws matter from the exterior of filler nozzle 14 across air gap 42 and through channels 44, 30 towards collection chamber 32. In the embodiment illustrated in FIGS. 2-3, vacuum pump 22 is located at a distance from manifold 18 and coupled to manifold 18 through port 39 using hoses or other conventional mechanisms. It should be understood, however, that vacuum pump 22 may be integrated with member 26 of manifold 18 in some embodiments.

A system 16 in accordance the present teachings represents an improvement as compared to conventional systems for preventing dripping from filler nozzles 14. The system 16 has a relatively low profile and is capable of use in locations where space constraints prevent movement of a drip tray into and out of position between the filler nozzles 14 and containers 12. The system 16 can also be easily adapted to existing filling systems 10. Finally, the system 16 can be easily removed from the filling system 10 for cleaning and other maintenance.

While a system for preventing dripping from one or more filler nozzles that provide matter to containers has been shown and described with reference to one or more particular embodiments thereof, it will be understood by those of skill in the art that various changes and modifications can be made without departing from the spirit and scope of the invention.

What is claimed is:

1. A system for preventing dripping from one or more filler nozzles that provide matter to containers, comprising:

a manifold defining a first bore extending therethrough and defining a manifold channel in communication with the first bore; and, a first nozzle ring supported within the first bore of the manifold and defining a bore configured to receive a first filler nozzle, the first nozzle ring defining an air gap between an inner surface of the first nozzle ring and an outer surface of the first filler nozzle, the first nozzle ring further defining a nozzle ring channel extending between the inner surface of the first nozzle ring and an outer surface of the first nozzle ring and in communication with the manifold channel, the first nozzle ring including an inner wall defining the inner surface of the first nozzle ring and an outer wall defining the outer surface of the first nozzle ring, wherein the nozzle ring channel is defined between an outer surface of the inner wall and an inner surface of the outer wall, wherein a negative pressure introduced into the channel in the manifold draws matter from the first filler nozzle through the channel in the first nozzle ring and the channel in the manifold.

2. The system of claim 1 wherein the matter is drawn directly from the outer surface of the first filler nozzle across the air gap and into the channel in the first nozzle ring.

3. The system of claim 1, wherein the manifold defines a second bore extending therethrough in communication with the channel in the manifold and further comprising a second nozzle ring supported within the second bore of the manifold and defining a bore configured to receive a second filer nozzle, the second nozzle ring defining an air gap between an inner surface of the second nozzle ring and an outer surface of the second filler nozzle, the second nozzle ring further defining a channel extending between the inner surface of the second nozzle ring and an outer surface of the second nozzle ring and in communication with the channel in the manifold, negative pressure introduced into the channel of the manifold drawing matter from the second filler nozzle through the channel in the second nozzle ring and the channel in the manifold.

4. The system of claim 1 wherein the manifold further defines a collection chamber in communication with the channel in the manifold.

5. The system of claim 1 wherein a length of the inner wall is less than a length of the outer wall.

6. A system for preventing dripping from one or more filler nozzles that provide matter to containers, comprising:

a manifold defining a first bore extending therethrough and defining a channel in communication with the first bore; and, a first nozzle ring supported within the first bore of the manifold and defining a bore configured to receive a first filler nozzle, the first nozzle ring defining an air gap between an inner surface of the first nozzle ring and an outer surface of the first filler nozzle, the first nozzle ring further defining a channel extending between the inner surface of the first nozzle ring and an outer surface of the first nozzle ring and in communication with the channel in the manifold, wherein a negative pressure introduced into the channel in the manifold draws matter from the first filler nozzle through the channel in the first nozzle ring and the channel in the manifold, wherein the first nozzle ring includes an inner wall defining the inner surface of the first nozzle ring and an outer wall defining the outer surface of the first nozzle ring, the inner and outer walls defining the channel of the first nozzle ring therebetween, a length of the inner wall being less than a length of the outer wall, wherein a length of the inner wall is constant and a length of the outer wall varies.

7. The system of claim 1, wherein a portion of the first bore in the manifold is smaller in size than the bore in the first nozzle ring.

8. A filling system for filling one or more containers with matter, comprising:

a first filler nozzle configured to provide matter to a first container;

a manifold defining a first bore extending therethrough and defining a manifold channel in communication with the first bore;

a first nozzle ring supported within the first bore of the manifold and defining a bore configured to receive the first filler nozzle, the first nozzle ring defining an air gap between an inner surface of the first nozzle ring and an outer surface of the first filler nozzle, the first nozzle ring further defining a first nozzle ring channel extending between the inner surface of the first nozzle ring and an outer surface of the first nozzle ring and in communication with the manifold channel, the first nozzle ring including a first inner wall defining the inner surface of the first nozzle ring and a first outer wall defining the outer surface of the first nozzle ring, wherein the first nozzle ring channel is defined between an outer surface of the first inner wall and an inner surface of the first outer wall; and, a vacuum pump configured to generate a negative pressure in the channel in the manifold to draw matter from the first filler nozzle through the channel in the first nozzle ring and the channel in the manifold.

9. The filling system of claim 8 wherein the matter is drawn directly from the outer surface of the first filler nozzle across the air gap and into the channel in the first nozzle ring.

10. The filling system of claim 8 wherein the manifold defines a second bore extending therethrough in communication with the channel in the manifold, the filling system further comprising:

a second filler nozzle configured to provide matter to a second container; and, a second nozzle ring supported within the second bore of the manifold and defining a second bore configured to receive the second filler nozzle, the second nozzle ring defining an air gap between an inner surface of the second nozzle ring and an outer surface of the second filler nozzle, the second nozzle ring further defining a second nozzle ring channel extending between the inner surface of the second nozzle ring and an outer surface of the second nozzle ring and in communication with the manifold channel, the second nozzle ring including a second inner wall defining the inner surface of the second nozzle ring and a second outer wall defining the outer surface of the second nozzle ring, wherein the second nozzle ring channel is defined between an outer surface of the second inner wall and an inner surface of the second outer wall, and negative pressure introduced into the channel of the manifold drawing matter from the second filler nozzle through the channel in the second nozzle ring and the channel in the manifold.

11. The filling system of claim 8 wherein the manifold further defines a collection chamber in communication with the channel in the manifold.

12. The filling system of claim 8 wherein a length of the inner wall is less than a length of the outer wall.

13. A filling system for filling one or more containers with matter, comprising:

a first filler nozzle configured to provide matter to a first container;

a manifold defining a first bore extending therethrough and defining a channel in communication with the first bore;

a first nozzle ring supported within the first bore of the manifold and defining a bore configured to receive the first filler nozzle, the first nozzle ring defining an air gap between an inner surface of the first nozzle ring and an outer surface of the first filler nozzle, the first nozzle ring further defining a channel extending between the inner surface of the first nozzle ring and an outer surface of the first nozzle ring and in communication with the channel in the manifold; and, a vacuum pump configured to generate a negative pressure in the channel in the manifold to draw matter from the first filler nozzle through the channel in the first nozzle ring and the channel in the manifold, wherein the first nozzle ring includes an inner wall defining the inner surface of the first nozzle ring and an outer wall defining the outer surface of the first nozzle ring, the inner and outer walls defining the channel of the first nozzle ring therebetween, a length of the inner wall being less than a length of the outer wall, wherein a length of the inner wall is constant and a length of the outer wall varies.

14. The filling system of claim 8, wherein a portion of the first bore in the manifold is smaller in size than the bore in the first nozzle ring.

15. The filling system of claim 8, further comprising a manifold cover on top of the manifold and defining a cover bore extending therethrough and aligned with the first bore of the manifold.

16. The filling system of claim 8, further comprising a manifold cover defining a cover bore extending therethrough and aligned with the first bore of the manifold wherein the manifold further defines a collection chamber in communication with the channel, and the manifold also defines a groove surrounding the first bore, the channel, and the collection chamber and configured to receive a seal.

17. The system of claim 1, further comprising a manifold cover on top of the manifold and defining a cover bore extending therethrough and aligned with the first bore of the manifold.

18. The system of claim 1, further comprising a manifold cover defining a cover bore extending therethrough and aligned with the first bore of the manifold, wherein the manifold further defines a collection chamber in communication with the channel, and the manifold also defines a groove surrounding the first bore, the channel, and the collection chamber and configured to receive a seal.

19. The system of claim 6, further comprising a manifold cover on top of the manifold and defining a cover bore extending therethrough and aligned with the first bore of the manifold, wherein the matter is drawn directly from the outer surface of the first filler nozzle across the air gap and into the channel in the first nozzle ring, wherein the manifold further defines a collection chamber in communication with the channel in the manifold, and wherein a portion of the first bore in the manifold is smaller in size than the bore in the first nozzle ring.

20. The system of claim 13, further comprising a manifold cover on top of the manifold and defining a cover bore extending therethrough and aligned with the first bore of the manifold, wherein the matter is drawn directly from the outer surface of the first filler nozzle across the air gap and into the channel in the first nozzle ring, wherein the manifold further defines a collection chamber in communication with the channel in the manifold, and wherein a portion of the first bore in the manifold is smaller in size than the bore in the first nozzle ring.

* * * * *